US006535085B2

(12) United States Patent
Song et al.

(10) Patent No.: US 6,535,085 B2
(45) Date of Patent: Mar. 18, 2003

(54) RESONATOR

(75) Inventors: Insang Song, Yongin (KR); Jungwoo Kim, Yongin (KR); Seokjin Kang, Yongin (KR); Hoon Song, Yongin (KR); Cimoo Song, Yongin (KR); Youngwoo Kwon, Seoul (KR); Changyul Cheon, Seoul (KR); Yong-gyo Seo, Yongin (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/925,309

(22) Filed: Aug. 10, 2001

(65) Prior Publication Data

US 2003/0030515 A1 Feb. 13, 2003

(30) Foreign Application Priority Data

Aug. 10, 2001 (KR) ..... 00-46345

(51) Int. Cl.[7] ..... H01P 7/00

(52) U.S. Cl. ..... 333/219; 333/219; 333/227; 333/230; 333/248

(58) Field of Search ..... 333/219, 248, 333/227, 230

(56) References Cited

U.S. PATENT DOCUMENTS 4,691,179 A * 9/1987 Blum et al. ..... 333/202
4,785,271 A * 11/1988 Higgins, Jr. ..... 333/204
4,963,844 A * 10/1990 Konishi et al. ..... 333/208
5,144,269 A * 9/1992 Itoh ..... 333/206
5,714,920 A * 2/1998 Ivanov et al. ..... 333/219.1
5,821,836 A * 10/1998 Katehi et al. ..... 333/202
6,020,798 A * 2/2000 Nakakubo et al. ..... 333/204
6,020,800 A * 2/2000 Arakawa et al. ..... 333/208
6,127,907 A * 10/2000 Furuya et al. ..... 257/528

* cited by examiner

*Primary Examiner*—Michael Tokar
*Assistant Examiner*—Linh Van Nguyen
(74) *Attorney, Agent, or Firm*—Burns Doane Swecker & Mathis LLP

(57) ABSTRACT

A resonator including a lower substrate having a groove, a dielectric filling the groove, a material film formed on the inner wall of the groove, the material film for preventing the permittivity from suddenly changing between the lower substrate and the dielectric, an upper substrate that is combined with the lower substrate to form a cavity, a conductive thin film formed on the lower surface of the upper substrate to face the dielectric and having a slot in contact with the material film and exposing the dielectric, and a strip line for a wave-guide that is formed on the upper part of the upper substrate and is connected to the conductive thin film. According to the resonator, the size of a cavity corresponding to a given resonance frequency can be reduced by filling a cavity with a dielectric (or magnetic material).

7 Claims, 6 Drawing Sheets

RESONATOR

BACKGROUND Of THE INVENTION

Priority is claimed to Korean Patent Application No. 00-46345 filed on Aug. 10, 2000, here incorporated by reference 1. Field of the Invention The present invention relates to a resonator, and more particularly, to a resonator in which a cavity is filled with a predetermined material.

2. Description of the Related Art

A resonator has been usually used as a tuning circuit in an antenna, a filter, a duplexer, communication appliances or electric appliances.

FIG. 1 is a separated perspective view illustrating a conventional resonator and FIG. 2 is a cross-sectional view of the resonator shown in FIG. 1 when combined.

Referring to FIGS. 1 and 2, the resonator includes a lower substrate 11 having a rectangular groove 12 and an upper substrate 16 that is combined with the lower substrate 11 to form a cavity 13.

The inner wall of the rectangular groove 12 on the lower substrate 11 is coated with a conductive thin film 14.

A strip line 17 for a wave-guide and a conductive thin film 19 having a partially cut slot 18 are formed on the upper surface and lower surface of the upper substrate 16, respectively.

The conductive thin film 19 is combined with the rectangular groove 12 to form the cavity 13.

A pole 20 connects the strip line 17 with the conductive thin films 14 and 19.

Resonators having the above-described structure are manufactured by semiconductor minute processing techniques. However, a resonance frequency of a cavity resonator is inversely proportional to the size of the cavity 13 rendering it too large to employ in many portable communication terminals, e.g., ones using a frequency of 2 GHz, which are being increasingly miniaturized.

SUMMARY OF THE INVENTION

To solve the above problem, it is an objective of the present invention to provide a resonator whose resonating structure corresponding to a resonance frequency can be reduced.

Accordingly, to achieve the above objective, there is provided a resonator including a lower substrate having a groove, a dielectric filling the groove, a material film which is formed on the inner wall of the groove and prevents permittivity from suddenly changing between the lower substrate and the dielectric, an upper substrate which is combined with the lower substrate thereby forming a cavity, a conductive thin film formed on the lower surface of the upper substrate to face the dielectric and having a slot in contact with the material film and exposing the dielectric, and a strip line for a wave-guide formed on the upper surface of the upper substrate and connected to the conductive thin film.

Here, the dielectric is composed of first and second dielectrics that have larger permittivities than air, and the permittivity of the first dielectric formed on the second dielectric is smaller than that of the second dielectric.

The material film is a dielectric film that has the permittivity between that of the dielectric and that of the lower substrate and is made of a paraffin film or a grease film.

Also, to achieve the above objective, the resonator includes a lower substrate having a groove, a magnetic material filling the groove, a material film which is formed on the inner wall of the groove and prevents permeability from suddenly changing between the lower substrate and the magnetic material, an upper substrate which is combined with the lower substrate to form a cavity, a conductive thin film formed on the lower surface of the upper substrate to face the magnetic material and having a slot in contact with the material film and exposing the magnetic material, and a strip line for a wave-guide which is formed on the upper part of the upper substrate and is connected to the conductive thin film. The magnetic material is made of first and second magnetic materials.

DETAILED DESCRIPTION OF THE INVENTION

Figure 1:
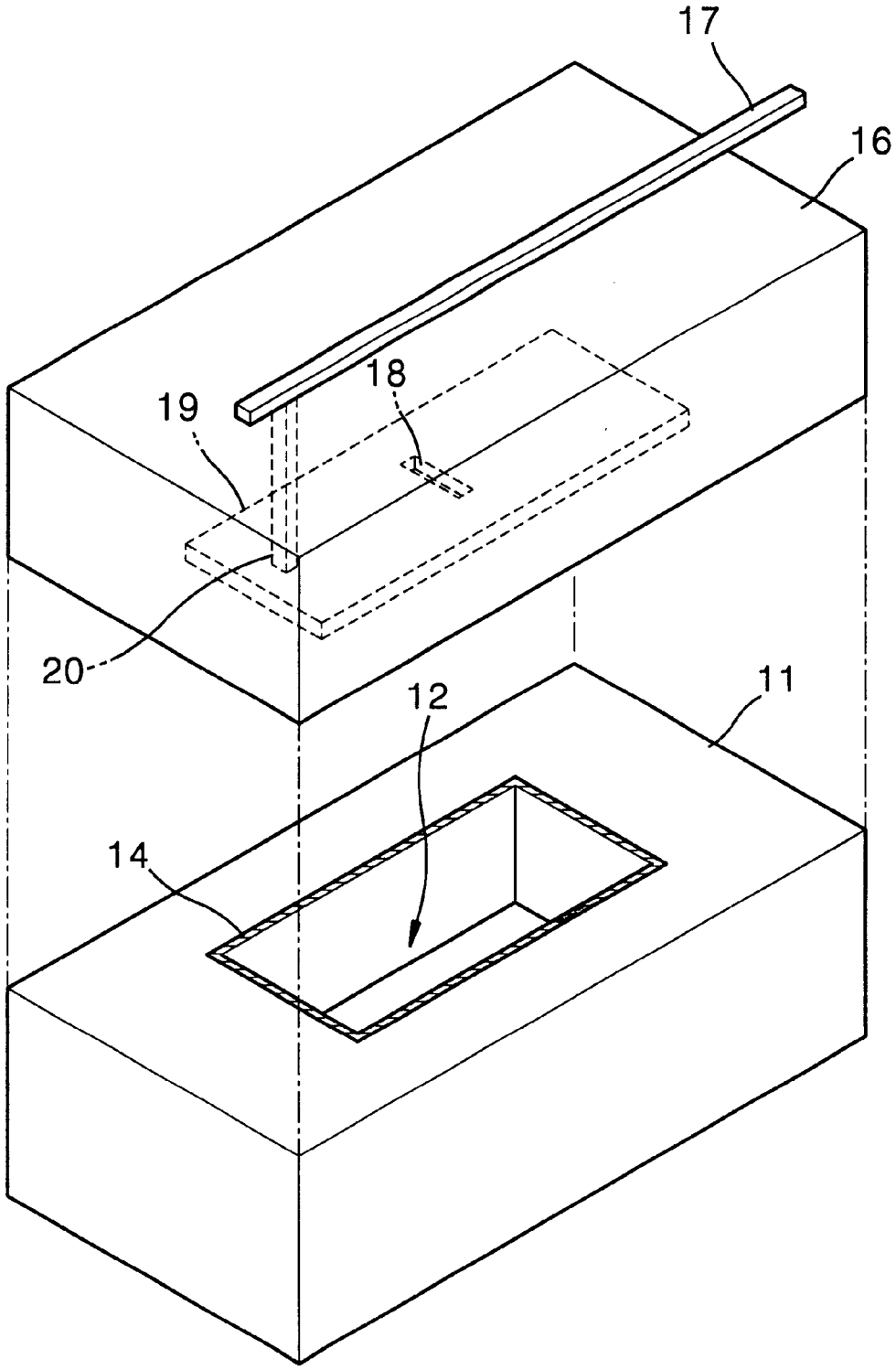
FIG. 1 (PRIOR ART)
FIG. 1 is a separated view and FIG. 2 is a cross-sectional view of conventional cavity resonators.
Figure 2:
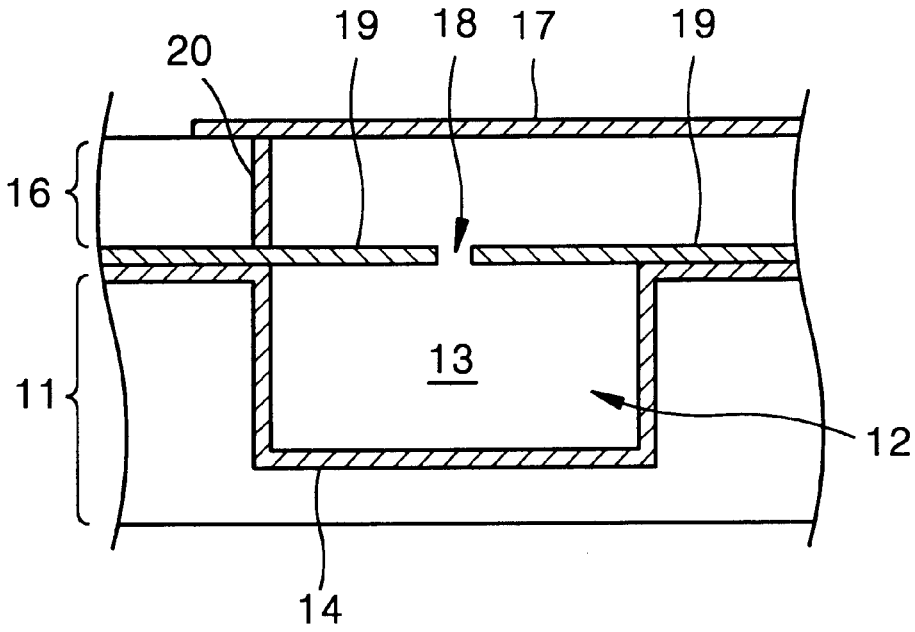
FIG. 2 (PRIOR ART)

Hereinafter, the present invention will be described in detail by explaining preferred embodiments 1 and 2 of the present invention with reference to the attached drawings. Like reference numerals in the drawings denote the same members.

Embodiment 1

Figure 3:
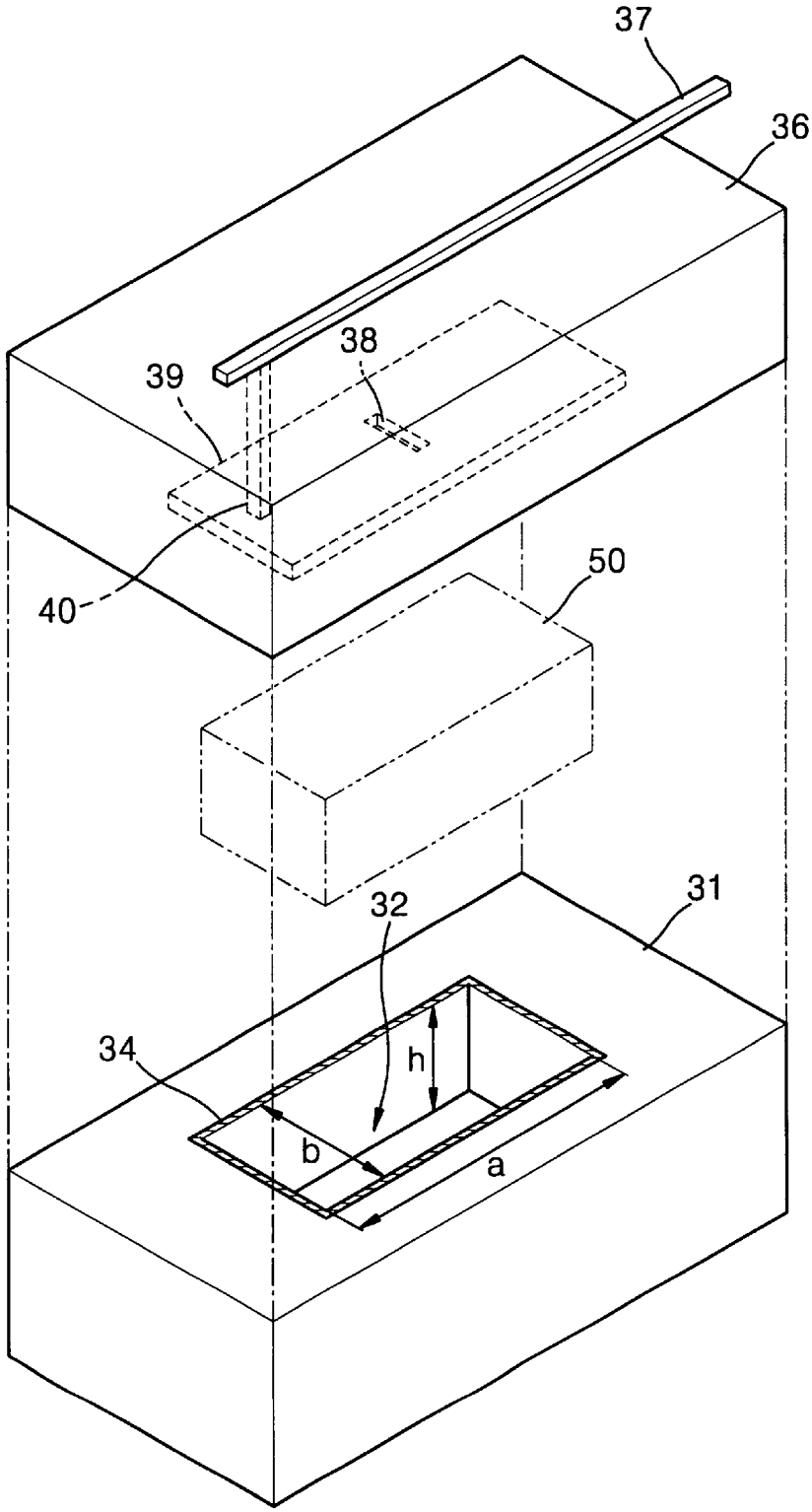
FIG. 3 is 1 separated perspective view and FIG. 4 is a cross-sectional view of a resonator according to a first embodiment of the present invention.
Figure 4:
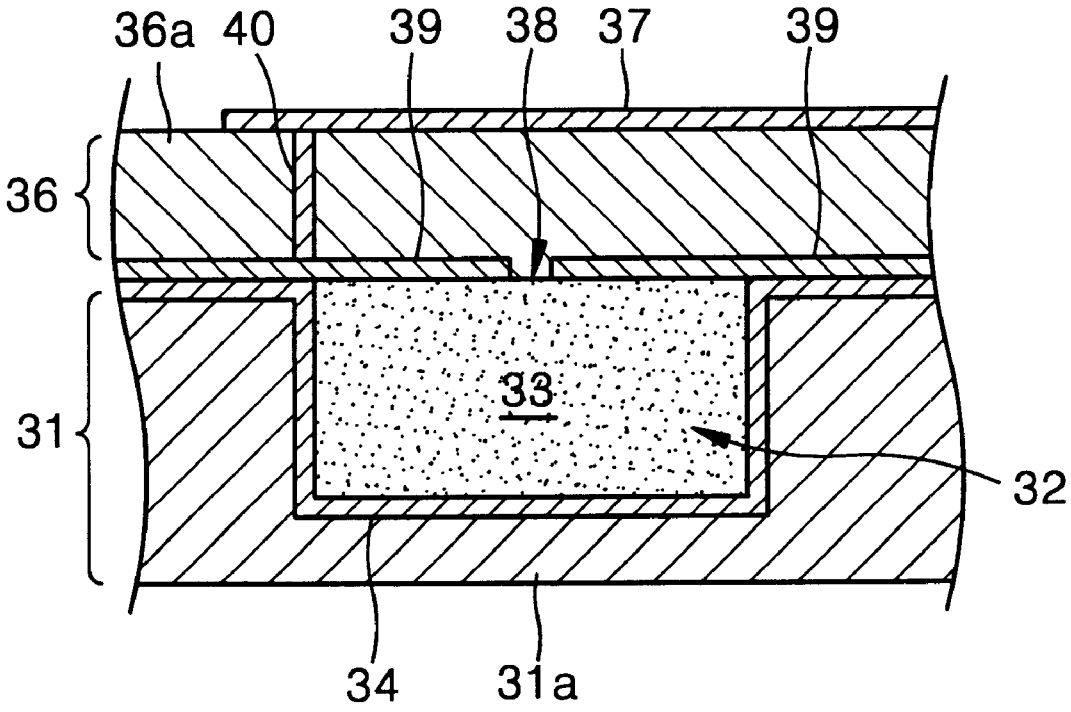

Referring to FIGS. 3 and 4, the resonator includes a lower substrate 31 having a rectangular groove 32 and an upper substrate 36, which is combined with the lower substrate 31 to form a cavity 33.

The lower substrate 31 comprises the rectangular groove 32 on a semiconductor wafer 31*a* such as Si, GaAs and InP, and the inner wall of the groove 32 is coated with a material film 34 which provides a seal between a dielectric 50 filling the groove 32 and the substrate 31. The material film 34 can be a conductive material film, e.g. a gold film.

A strip line 37 for a wave-guide and a conductive thin film 39 having a partially cut slot 38 are formed on the upper part and lower part of the upper substrate 36, respectively. In forming the upper substrate 36, the strip line 37, the lower conductive thin film 39 which may be gold, and a pole 40 are formed of a conductive material on a semiconductor wafer 36*a* such as a Si, GaAs or Inp wafes.

The conductive thin film 39 formed on the lower part of the upper substrate 36 is combined with the groove 32 which is formed on the lower substrate 31 to form the cavity 33. The inner part of the cavity 33 can be filled with a magnetic material that has a larger permittivity than an air instead of a dielectric 50.

The strip line 37 is connected with the conductive thin film 39 by means of the pole 40.

The resonance frequency of a resonator having the cavity 33 filled with the dielectric 50 (or magnetic material) having a larger permittivity than air is given by the following equation 1:

$$f_{mnl} = \frac{1}{2\pi\sqrt{\mu\varepsilon}}\sqrt{\left(\frac{m}{a}\right)^2 + \left(\frac{n}{h}\right)^2 + \left(\frac{l}{b}\right)^2} \quad (1)$$

Here, $\mu$ denotes the permeability of free space and e denotes the permittivity of free space. l, m and n are fixed numbers indicating a resonating mode and a, b and h indicate the width, height and depth of the cavity 33, respectively. As can be seen from the above equation 1, if permeability and permittivity increase, a, b and h must decrease in order for a resonance frequency value not to change. That is, a, b and h become smaller with regard to the same resonance frequency when the cavity 33 is filled with the dielectric 50 (or magnetic material), than when the cavity 33 is vacant. Based on this principle, the resonator according to the present invention having the cavity filled with the dielectric 50 (or magnetic material) provides a smaller-sized cavity structure corresponding to a resonance frequency.

Embodiment 2

As described above, the size of a resonator can be reduced based on the principle that, for a given frequency, the larger the permittivity of the dielectric 50 is, the smaller the size of a cavity must be. However, considering that an antenna is exposed to air and the permittivity of air is 1, the greater part of a radio wave which is transmitted to the dielectric 50 via the strip line 37, the pole 40 and the conductive thin film 39 is reflected due to the large increase in permittivity between air and the dielectric 50 at the border with the dielectric 50, and as a result a receiving rate may be reduced.

To solve this problem, a dielectric, which is constructed of at least two dielectrics of different permittivity successively arranged in order of increasing permittivity, will be presented here.

Figure 5:
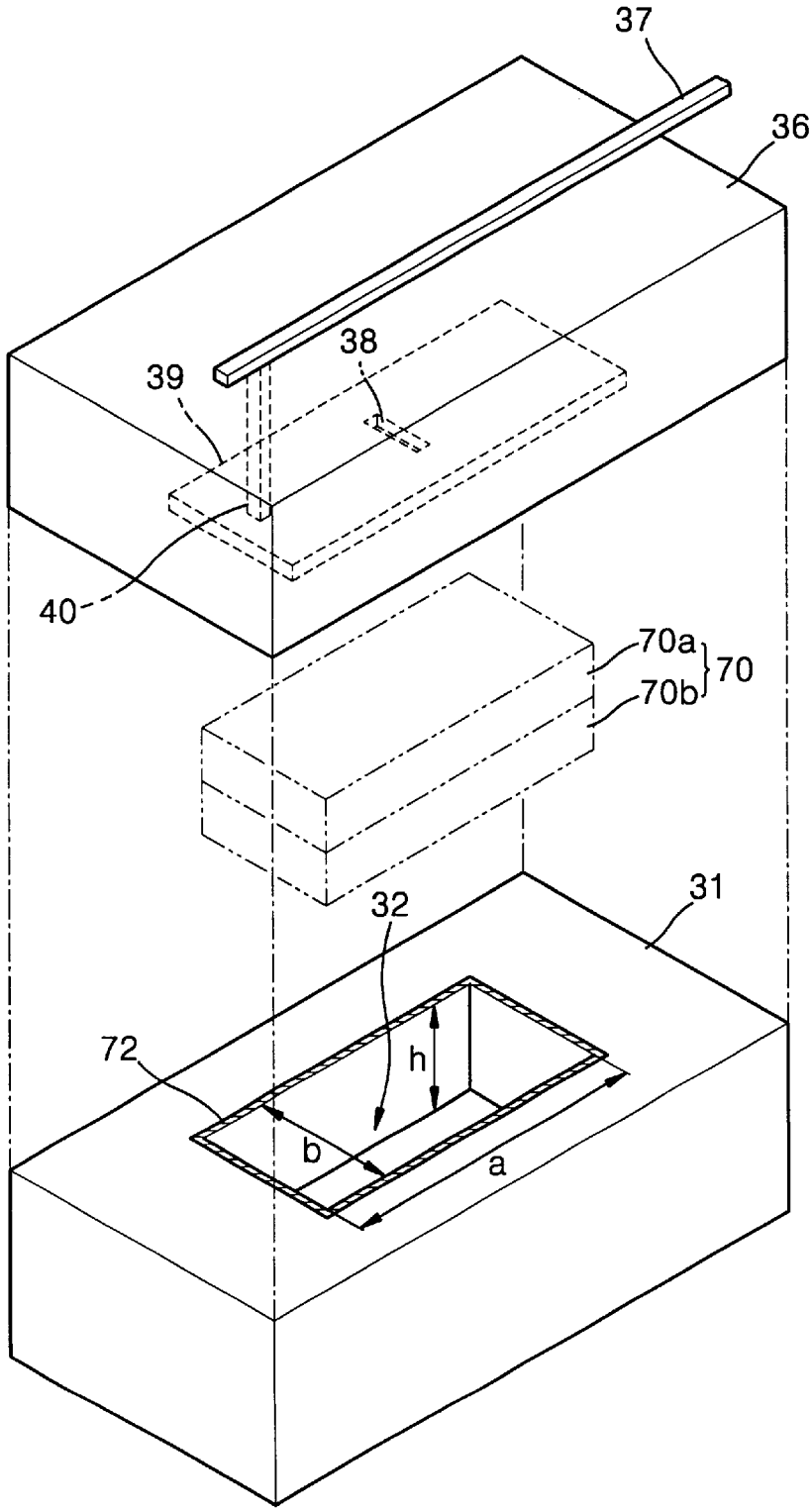
FIG. 5 is a separated perspective view and FIG. 6 is a cross-sectional view of a resonator according to a second embodiment of the present invention.
Figure 6:
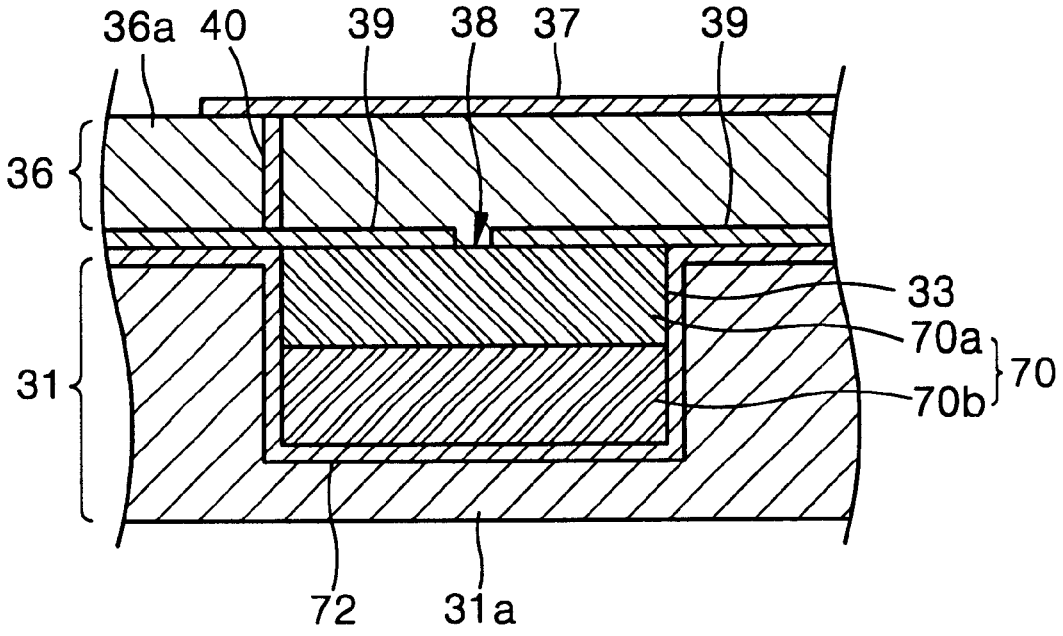

Specifically, referring to FIGS. 5 and 6, a dielectric 70 filling the cavity 33 is composed of first and second dielectrics 70*a* and 70*b*. The permittivity of the first dielectric 70*a* formed on the second dielectric 70*b* is smaller than that of the second dielectric 70*b*.

A radio wave which is incident on the dielectric 70 propagates to the semiconductor wafer 31*a* encompassing the cavity 33 via a transition material film 72, which is formed on the inner walls of the cavity 33. At that time, in the event that air is present between the dielectric 70 and the semiconductor wafer 31*a*, a receiving rate is lower because a radio wave is reflected at a border surface between the air and the dielectric having a high permittivity. Thus, it is preferable that the transition material film 72 is formed of a material having a permittivity between that of air and that of the dielectric 70. For example, the transition material film 72 is a dielectric film having a permittivity between that of silicon constituting the semiconductor wafer 31*a* and that of the dielectric 70. The transition material film 72 can be a paraffin film or a grease film that softens the insertion of the dielectric 70 and excludes air. When the transition material film 72 is a dielectric film described above, a radio wave which is incident on the dielectric 70 propagates in the order of the dielectric 70, the paraffin film (or the grease film) and silicon and thus, reflectance can be reduced at the borders between dielectrics and therefore a radio wave can effectively propagate.

The dielectric 70 and first and second dielectrics 70*a* and 70*b* can be replaced with a magnetic material having the above-mentioned features.

As described above, the size of a cavity corresponding to a given resonance frequency can be reduced in the resonator according to the embodiment of the present invention by filling a cavity with a dielectric (or magnetic material) or diversifying the dielectric (or magnetic material). Further, reflectance of a radio wave due to large changes in the permittivity of the medium of propagation can be reduced by making the dielectric with a plurality of dielectrics whose premittivities increase sequentially and inserting a material, which has an approximately halfway between that of the dielectric and a material encompassing the dielectric and which excludes air, into a material encompassing and contacting the dielectric, thereby enabling a radio wave to effectively propagate.

While the present invention has been particularly shown and described with reference to the preferred embodiment thereof, it will be understood by those skilled in the art that various changes in form and details may be made thereto without departing from the spirit and scope of the invention as defined by the appended claims.

What is claimed is:

1. A resonator, comprising:

a lower substrate having a groove;

a dielectric filling the groove;

a material film formed on the inner wall of the groove, the material film for preventing permittivity from suddenly changing between the lower substrate and the dielectric, wherein the material film is a dielectric film that has a permittivity between that of the dielectric and lower substrate;

an upper substrate combined with the lower substrate, thereby forming a cavity;

a conductive thin film formed on the lower surface of the upper substrate to face the dielectric and having a slot in contact with the material film and exposing the dielectric; and a strip line for a wave-guide formed on the upper surface of the upper substrate and connected to the conductive thin film.

2. The resonator as claimed in claim 1, wherein the dielectric film is a paraffin film or a grease film.

3. The resonator as claimed in claim 1, wherein the dielectric comprises a first and a second dielectric that have larger permittivities than air, and the permittivity of the first dielectric located on the second dielectric is smaller than that of the second dielectric.

4. A resonator, comprising:

a lower substrate having a groove;

a dielectric filling the groove, wherein the dielectric comprises a first and a second dielectric that have larger permittivities than air, and the permittivity of the first dielectric located on the second dielectric is smaller than that of the second dielectric;

a material film formed on the inner wall of the groove, the material film for preventing permittivity from suddenly changing between the lower substrate and the dielectric;

an upper substrate combined with the lower substrate, thereby forming a cavity;

a conductive thin film formed on the lower surface of the upper substrate to face the dielectric and having a slot in contact with the material film and exposing the dielectric; and a strip line for a wave-guide formed on the upper surface of the upper substrate and connected to the conductive thin film.

5. A resonator, comprising:

a lower substrate having a groove;

a magnetic material filling the groove;

a material film formed on the inner wall of the groove, the material film for preventing permeability from suddenly changing between the lower substrate and the magnetic material, wherein the material film is a magnetic film that has a permeability between that of the magnetic material and that of the lower substrate;

an upper substrate combined with the lower substrate, thereby forming a cavity;

a conductive thin film formed on the lower surface of the upper substrate to face the magnetic material and having a slot in contact with the material film and exposing the magnetic material; and a strip line for a wave-guide formed on the upper surface of the upper substrate and connected to the conductive thin film.

6. The resonator as claimed in claim 5, wherein the magnetic material is made of a first and a second magnetic material that have larger permeabilities than air, and the permeability of the first magnetic material located on the second magnetic material is smaller than that of the second magnetic material.

7. A resonator, comprising:

a lower substrate having a groove;

a magnetic material filling the groove, wherein the magnetic material is made of a first and a second magnetic material that have larger permeabilities than air, and the permeability of the first magnetic material located on the second magnetic material is smaller than that of the second magnetic material;

a material film formed on the inner wall of the groove, the material film for preventing permeability from suddenly changing between the lower substrate and the magnetic material;

an upper substrate combined with the lower substrate, thereby forming a cavity;

a conductive thin film formed on the lower surface of the upper substrate to face the magnetic material and having a slot in contact with the material film and exposing the magnetic material; and a strip line for a wave-guide formed on the upper surface of the upper substrate and connected to the conductive thin film.

* * * * *

UNITED STATES PATENT AND TRADEMARK OFFICE

CERTIFICATE OF CORRECTION

PATENT NO. : 6,535,085 B2
DATED : March 18, 2003
INVENTOR(S) : Insang Song et al.

It is certified that error appears in the above-identified patent and that said Letters Patent is hereby corrected as shown below:

Title page,
Item [75], Inventors, change "Jungwoo Kim" to -- Chungwoo Kim --.

Signed and Sealed this

Thirteenth Day of July, 2004

JON W. DUDAS
*Acting Director of the United States Patent and Trademark Office*